US006949497B2

(12) United States Patent
Cordellina et al.

(10) Patent No.: US 6,949,497 B2
(45) Date of Patent: Sep. 27, 2005

(54) CONTAINER COMPRISING LIQUID DETERGENT COMPOSITIONS

(75) Inventors: Antonio Cordellina, Abano Terme (IT); Giorgio Franzolin, Mirano (IT); Daniele Fregonese, Ludwigshafen (DE); Alessandro Latini, Bologna (IT); Sara Quaggia, Piove di Sacco (IT)

(73) Assignee: Reckitt Benckiser N.V., Hoofddorp (NZ)

( * ) Notice: Subject to any disclaimer, the term of this patent is extended or adjusted under 35 U.S.C. 154(b) by 54 days.

(21) Appl. No.: 10/466,050

(22) PCT Filed: Jan. 17, 2002

(86) PCT No.: PCT/GB02/00185

§ 371 (c)(1),
(2), (4) Date: Jul. 9, 2003

(87) PCT Pub. No.: WO02/057398

PCT Pub. Date: Jul. 25, 2002

(65) Prior Publication Data

US 2004/0053805 A1 Mar. 18, 2004

(30) Foreign Application Priority Data

Jan. 19, 2001 (GB) ..... 0101480
May 25, 2001 (GB) ..... 0112774

(51) Int. Cl.[7] ..... C11D 17/00

(52) U.S. Cl. ..... 510/295; 510/296; 510/338; 510/371; 510/357; 510/407; 510/414; 510/424; 510/426; 510/439

(58) Field of Search ..... 510/295, 296, 510/338, 371, 414, 424, 439, 357, 407, 492, 497, 495

(56) References Cited

U.S. PATENT DOCUMENTS

| | | | | |
|---|---|---|---|---|
| 3,981,998 A | | 9/1976 | Waldstein | 424/249 |
| 6,239,094 B1 | * | 5/2001 | Goderis et al. | 510/357 |

FOREIGN PATENT DOCUMENTS

| | | | |
|---|---|---|---|
| EP | 0 479 404 | 3/1991 | C11D/17/04 |
| EP | 0 070 074 | 6/1997 | C11D/1/83 |
| GB | 1 527 141 | 10/1978 | C11D/10/02 |
| WO | WO 92/09677 | 6/1992 | C11D/17/00 |
| WO | WO 98/00509 | 1/1998 | C11D/17/00 |
| WO | WO 00/12659 | 3/2000 | C11D/1/83 |

* cited by examiner

*Primary Examiner*—Necholus Ogden
(74) *Attorney, Agent, or Firm*—Norris, McLaughlin & Marcus

(57) ABSTRACT

A liquid detergent composition comprising: a) an alkyl benzene sulfonic acid neutralized with an alkanolamine, said alkyl benzene sulfonic acid containing less than 25%, preferably less than 20%, of the 2-phenyl isomer; and b) an organic solvent; said composition containing less than 3 wt. % water.

20 Claims, No Drawings

CONTAINER COMPRISING LIQUID DETERGENT COMPOSITIONS

The present invention relates to liquid detergent compositions, especially compositions which dissolve and disperse satisfactorily in water.

Liquid detergent compositions comprising surfactants are known. Such compositions can be used, for example, for laundry use, for example for fine-fabric laundry use or for heavy duty laundry use, or as hand or machine dishwashing compositions. They may also be used in liquid toilet rim blocks and as hard surface cleaners. In general detergent compositions comprise a large amount of water. For example, hand dishwashing compositions often contain up to 80 wt % water. Such compositions do not generally have any compatibility problems when being diluted with a large quantity of water.

EP 0907711 describes non-aqueous anionic containing detergent compositions in which the anionic is an alkali-metal salt of $C_{10}$–$C_{16}$ alkyl benzene sulfonic acid and having a 2-phenyl isomer content lower than 22%. Such compositions are described as providing stable and pourable compositions. Also described is that the alkylbenzene sulfonate anionic surfactant is a solid which only partially dissolves in the non-aqueous liquid diluent, so as to form the structural phase.

For some purposes it is desirable to have detergent compositions which are anhydrous or substantially anhydrous. However, such compositions may be difficult to disperse or dissolve in large quantities of water. In particular they may gel when diluted with water.

We have surprisingly discovered a composition which overcomes this problem of gelling.

Accordingly the present invention provides a liquid detergent composition comprising:

a) an alkyl benzene sulfonic acid neutralised with an alkanolamine, said alkyl benzene sulfonic acid containing less than 25%, preferably less than 20%, of the 2-phenyl isomer; and b) an organic solvent; said composition containing less than 5 wt % ideally less than 3 wt % water. Larger amounts of water can be found in the composition which is chemically or physically bound. Therefore, the amount of water is preferably less than 5 wt %, ideally less than 3 wt %, of free water. By free water we mean water that is not physically or chemically bound.

It is known that alkyl benzene sulfonic acids can be produced by a variety of processes in which an alkyl chain is attached to a benzene ring by a catalysed reaction. Various catalysts are known. It is usual in liquid detergents to use an alkyl benzene sulfonic acid produced using an $AlCl_3$ catalyst. Such alkyl benzene sulfonic acids typically contain at least 25% of the 2-phenyl isomer, that is the isomer in which the alkyl chain is attached to the benzene ring at the 2-position of the alkyl chain. The use of alkyl benzene sulfonic acids produced using other catalysts is in many cases avoided because they have disadvantages. For example, the alkyl benzene sulfonic acid produced by a process using a hydrogen fluoride (HF) catalyst is generally not used in aqueous compositions because the alkyl benzene sulfonic acid produced can give a cloudy appearance to the detergent composition, especially when used at a high concentration and in combination with electrolytes.

The liquid detergent composition of the present invention must contain an alkyl benzene sulfonic acid neutralised with an alkanol amine which contains less than 25%, preferably less than 20%, of the 2-phenyl isomer. Preferably it contains less than 15%, and more preferably less than 12% or less than 10% of the 2-phenyl isomer.

The alkyl benzene sulfonic acids produced using a HF catalyst contains less than 25%, preferably less than 20%, of the 2-phenyl isomer and can therefore be used in the present invention. Such alkyl benzene sulfonic acids are commercially available, for example as Solfodac AC3-I from Condea or Petresul 550 from Petresa.

The alkyl benzene sulfonic acid may be produced using other catalysts, for example $AlCl_3$, if an additional step, for example a separation step, is carried out to ensure that the final composition contains less than 25%, preferably less than 20%, of the 2-phenyl isomer in relation to the total amount of alkyl benzene sulfonic acid isomers present.

The alkyl benzene sulfonic acid contains other isomers, in particular the 3-, 4-, 5- and 6-phenyl isomers. These may be present in any proportions relative to each other. The alkyl chain may be linear or branched, although linear is preferred. The alkyl chain is generally a $C_{9-14}$ alkyl chain, for example a $C_{10-13}$ alkyl chain. A single alkyl benzene sulfonic acid, or a mixture of two or more, may be used.

The alkyl benzene sulfonic acid is preferably neutralised with an alkanol amine. It is not possible to neutralise it with, for example, sodium or potassium hydroxide, since this leads to a solid product rather than a liquid product. (for example as described in EP 0907711). The alkanol amine may contain one, two or three alkanol groups, which may be same or different. For example it can contain one, two or three methanol, ethanol, propanol or isopropanol groups. Desirably it is a monoethanolamine, diethanolamine or triethanolamine or a mixture thereof. Particularly desirable is a mixture of monoethanolamine and triethanolamine, for example in a weight ratio of from 1:1 to 1:2, especially from 1:1.25 to 1:1.75, more especially about 1:1.5, which may lead to enhanced generation of foam.

The alkylbenzene sulfonic acid neutralised with an alkanolamine is capable of fully dissolving/mixing into liquid diluents with low water content which may Be clear, and which are chemically an physically stable over extended periods, at least 6 months and/or up to 36 months.

The organic solvent may be any organic solvent, although it is desirable that it is miscible with water. Examples of organic solvents are glycols, glycerine or an alcohol. Preferred organic solvents are $C_{1-4}$ alcohols such as ethanol or propanol, and $C_{2-4}$ glycols such as monoethylene glycol and monopropylene glycol.

The composition of the present invention may contain further surfactants such as anionic, nonionic, amphoteric, cationic or zwitterionic surfactants, or a mixture thereof.

Anionic surfactants may include anionic organic surfactants, usually employed in soluble salt forms, preferably as alkali metal salts, especially as sodium salts. Although other types of anionic surfactants may be utilized, such as higher fatty acyl sarcosides, soaps of fatty acids (including metal soaps and amine soaps), preferred anionic surfactants are those which are described as of a sulfonate or sulfate type, which may be designated as sulf(on)ates. These include higher fatty alcohol sulfates, higher fatty alcohol polyalkoxylate sulfates, olefin sulfonates, α-methyl ester sulfonates and paraffin sulfonates. An extensive listing of anionic detergents, including such sulf(on)ate surfactants, is given on pages 25 to 138 of the text Surface Active Agents and Detergents, Vol. II, by Schwartz, Perry and Berch, published in 1958 by Interscience Publishers, Inc. Usually the higher alkyl group of such anionic surfactants has 8 to 24 carbon atoms, especially 10 to 20 carbon atoms, preferably 12 to 18 carbon atoms, and the alkoxylate content of such anionic surfactants that are alkoxylated (preferably ethoxylated or ethoxylated/propoxylated) is in the range of 1 to 4 moles of alkoxy groups per mole of surfactant.

Another preferred class of anionic surfactants comprises alkali metal (preferably sodium) alkyl sulfates, preferably having linear alkyl groups of 12 to 18 carbon atoms.

Another preferred class of anionic surfactants comprises alkali metal (preferably sodium) alkoxylated sulfates, preferably having linear alkyl groups of 12 to 18 carbon atoms, and preferably having 1 to 4 moles of alkoxy groups per mole of surfactant.

Non-ionic surfactants may be selected from, for example, alcohol alkoxylates such as alcohol ethoxylates, also known as alkylpoly(ethylene oxides) and alkylpolyoxyethylene ethers, alkylphenol ethoxylates, ethylene oxide/propylene oxide block copolymers, alkyl polyglucosides, alkanolamides and amine oxides. Alcohol ethoxylates, alkylphenol ethoxylates and ethylene oxide/propylene oxide block copolymers are condensation products of higher alcohols with lower alkylene oxides.

In such non-ionic surfactants the higher fatty moiety will normally be of 11 to 15 carbon atoms and there will usually be present from 3 to 20, preferably from 3 to 15, more preferably from 3 to 10, and most preferably from 3 to 7, moles of alkylene oxide per mole of higher fatty alcohol.

Non-ionic surfactants of interest include alkyl polyglucosides, the hydrophobic carbon chain length varying from 8 to 16 carbon atoms depending on the feedstock (oleochemical or petrochemical) and the hydrophilic polyglucose chain length varying between one and more than eight units of glucose.

Amphoteric surfactants may be selected from, for example, alkyl betaines, alkyl/aryl betaines, amidoalkyl betaines, imidazolinium-type betaines, sulfobetaines and sultaines.

The anionic surfactants, including the alkyl benzene sulfonic acid neutralised with an alkanolamine, are suitably present in a total amount of at least 10 wt %, and more preferably at least 20 wt % based on the total weight of the composition. The anionic surfactants are also suitably present in an amount of up to 95 wt %, preferably up to 70 wt %, more preferably up to 60 wt %, and ideally up to 40 wt %, based on the total weight of the composition.

One or more non-ionic surfactant (s), when present, is/are suitably present in an amount of at least 0.1 wt %, preferably at least 0.5 wt %, more preferably at least 1 wt %. Good compositions can also be prepared with higher amounts of non-ionic surfactant(s), for example in an amount of at least 2 wt %, preferably at least 4 wt %, and most preferably at least 8 wt %, based on the total weight of the composition. One or more non-ionic surfactant(s), when present, is/are suitably present in an amount of up to 80 wt %, preferably up to 70 wt %, more preferably up to 50 wt %, most preferably up to 35 wt %, and especially up to 20 wt %, based on the total weight of the composition.

One or more amphoteric surfactant(s), when present, is/are suitably present in an amount of at least 0.1 wt %, preferably at least 02 wt %, more preferably at least 04 wt %, based on the total weight of the composition. Good compositions can also be prepared with higher amounts of amphoteric surfactant(s), for example at least 1 wt %, preferably at least 2 wt %, more preferably at least 5 wt %, based on the total weight of the composition. One or more amphoteric surfactant(s), when present, is/are suitably present in an amount of up to 30 wt %, preferably up to 20%, more preferably up to 15 wt %, based on the total weight of the composition.

A preferred laundry detergent composition includes as surfactant(s) the one or more alkyl benzene sulfonic acids neutralised by an alkanolamine, optionally one or more further anionic surfactants, and one or more non-ionic surfactant(s). Preferably such surfactant(s) is/are the only surfactant(s) or the major surfactant(s) present in the composition. By this we mean such surfactants including alkyl benzene sulfonic acids neutralised with an alkanolamine are present in a larger amount by weight than all other surfactant types in total, and preferably constitute at least 60 wt %, preferably at least 80 wt %, more preferably at least 95 wt %, and most preferably 100 wt % of the total weight of surfactants in the composition.

Especially preferred compositions employ the alkyl benzene sulfonic acid neutralised with an alkanolamine as the cleansing surfactant(s) and no further surfactants. Alternative preferred compositions also employ one or more non-ionic cleansing surfactants, the weight ratio of the former to the latter being at least 2:1, preferably at least 4:1.

In an alternative and preferred embodiment the weight ratio of the alkyl benzene sulfonic acid salt to the non-ionic surfactant is at least 1:1, were preferably at least 0.75:1.

The surfactants in total suitably provide at least 10 wt %, more preferably at least 20 wt %, most preferably at least 30 wt %, and especially at least 50 wt % of the total weight of a laundry detergent composition. Suitably the surfactants in total provide(s) up to 99 wt %, especially up to 95 wt %, for example up to 70 wt %, of the total weight of the composition.

A detergent composition of the present invention may include one or more further components such as desiccants, sequestrants, enzymes, silicones, emulsifying agents, viscosifiers, acids, bases, pH regulators (buffers), bleaches, bleach activators, hydrotropes, opacifiers, builders, foam controllers, solvents, preservatives, disinfectants, pearlising agents, limescale preventatives, such as citric acid, optical brighteners, dye transfer inhibitors, thickeners, gelling agents, colour fading inhibitors and aesthetic ingredients, for example fragrances and colourants.

Suitable foam controllers are soaps, for example based on coconut fatty acids. Such controllers may be present in an amount of up to 20 wt %, for example up to 10 wt %, preferably 1 to 5 wt %, especially 2 to 3 wt %, especially about 2.5 wt %, of the composition based on the total amount of the composition.

The alkyl benzene sulfonic acid neutralised with an alkanolamine is preferably present in the composition of the present invention in an amount of up to 70 wt %, for example from 10 to 60 wt %. For concentrated compositions an amount of 40 to 60 wt % may be appropriate whereas for dilute compositions an amount of from 10 to 30 wt % may be more appropriate.

In an alternative and preferred embodiment the alkyl benzene sulfonic acid neutralised with an alkanolamine is present in an amount of 10 to 20 wt %.

The organic solvent may be present in the composition in any amount, for example in an amount of up to 50 wt %. Preferably it is present in an amount of from 5 to 30 wt %, especially from 10 to 20 wt %, especially about 15 wt %.

In an alternative and preferred embodiment the organic solvent is present in the composition in an amount of 35 to 55 wt %. Ideally the solvent is monopropylene glycol or a blend of monopropylene glycol and glycerine (ideally 80:20 to 20:80 wt ratio).

The composition of the present invention contains less than 3 wt % water. Compositions containing more than 3 wt % water may not be stable on storage or may have a cloudy appearance. Desirably the composition contains less than 2 wt % water, even more desirably less than 1 wt % water. Most preferably, the composition is substantially anhydrous. It will be appreciated that higher water content could be included in substantially anhydrous systems when it is chemically or physically bound.

The liquid detergent composition of the present invention may have a wide variety of uses. Thus it may be used, for example, as a laundry detergent composition, for example, for fine fabrics such as wool or for heavy duty laundry use such as for a normal wash. Alternatively, the composition may be a wash booster for adding to the wash in addition to the usual detergent used. It may also be used as a hard-surface cleaner or in a liquid toilet rim block of the type described in EP-A-538,957 or EP-A-785,315. The composition may also be used as a hard-surface cleaning composition or as a liquid hand or machine dishwashing composition.

The present composition is especially suitable for use in a water-soluble container where the container is simply added to a large quantity of water and dissolves, releasing its contents. The favourable dissolution and dispersion properties of the composition of the present invention are particularly useful in this context.

Thus the present invention also provides a water-soluble container containing a composition as defined above.

The water-soluble container may comprise a thermoformed or injection moulded water-soluble polymer. It may also simply comprise a water-soluble film. Such containers are described, for example, in EP-A-524,721, GB-A-2,244,258, WO 92/17,381 and WO 00/55,068.

In all cases, the polymer is formed into a container or receptable such as a pouch which can receive the composition, which is filled with the composition and then sealed, for example by heat sealing along the top of the container in vertical form-fill-processes or by laying a further sheet of water-soluble polymer or moulded polymer on top of the container and sealing it to the body of the container, for example by heat sealing.

Desirably the water-soluble polymer is a poly(vinyl alcohol) (PVOH). The PVOH may be partially or fully alcoholised or hydrolysed. For example, it may be from 40 to 100% preferably 70 to 92%, more preferably about 88%, alcoholised or hydrolysed, polyvinyl acetate. When the polymer is in film form, the film may be cast, blown or extruded.

The water-soluble polymer is generally cold water (20° C.) soluble, but depending on its chemical nature, for example the degree of hydrolysis of the PVOH, may be insoluble in cold water at 20° C., and only become soluble in warm water or hot water having a temperature of, for example, 30° C., 40 C, 50° C. or even 60° C. Because the composition contains only up to 3 wt % water, the composition will not attack the PVOH container.

The containers of the present invention find particular use where a unit-dosage form of the composition is required. Thus, for example, the composition may be a dishwashing or laundry detergent composition, especially for use in a domestic washing machine. The use of the container may place restrictions on its size. Thus, for example, a suitable size for a container to be used in a laundry or dishwashing machine is a rounded cuboid container having a length of 1 to 5 cm, especially 3.5 to 4.5 cm, a width of 1.5 to 3.5 cm, especially 2 to 3 cm, and a height of 1 to 2 cm, especially 1.25 to 1.75 cm. The container may hold, for example, from 10 to 40 g of the composition, especially from 15, 20 or 30 to 40 g of the composition for laundry use or from 15 to 20 g of the composition for dishwashing use.

The composition of the present invention may have a pH of, for example, 5 to 9, especially 5.5 to 7, more especially 5.5 to 6.5. The viscosity, measured using a Brookfield viscometer, model DV-II+, with spindle S31 at 12 RPM and at 20° C., is desirably 500 to 3000 cps, especially 800 to 1500 cps, more especially about 1100 cps.

The present invention is now further described in the following Examples, in which all of the parts are parts by weight unless otherwise mentioned.

A preferred additional additive is an enzyme, especially an protease, or a mixture of enzymes (such as protease combined with a lipase and/or a cellulase and/or an amylase, and/or a cutinase and/or a peroxidase enzyme). Such enzymes are well known and are adequately described in the literature (see WO 00/23548 page 65 to 68, which is incorporated herein by reference).

The enzyme will be present in an amount of, by weight, 0.1 to 5.0%, ideally 0.3% to 4.0% and preferably 1% to 3%.

The viscosity of the composition of the present invention, measured using a Brookfield viscometer, model DV-II+, with spindle S31 at 12 RPM and at 20° C., is desirably 500 to 3000 cps, more especially 8.00 to 1500 cps, especially about 1100 cps.

Specific compositions described herein have a very low viscosity, despite having high surfactant contacts, and are a preferred feature of the invention having several advantages in handling and the filling of containers.

Low viscosity compositions are characterised in that they are made changing the weight ratio sulfonic acid/nonionic, preferably the presence of a second surfactant causes the formation of mixed micelles that have a different aggregation behavior in terms of inter-micellar strength so the viscosity drop on decreasing the molar ratio Sulfonic acid/nonionic. In the table are reported the data relating formula in which the overall content of surfactants is not changed but the ratio sulfonic acid/nonionic is decreased this is correlates with the viscosity determined with a Brookfield viscometer DV E spindle 1 speed 10 rpm Table (matrix: surfactants 38% enzyme 2%, glycerol 8%, Borax 2%, monopropylene glycol 40.9%, Kathon 0.1%, Peg 200 5%, coconut oil 2%, MEA 3.5%.) T=20° C., Brookfield DV-E, rpm 10, spindle 1.

| Viscosity | LAS[1]/nonionic[2] |
|---|---|
| 300 | 0/38 |
| 80 | 15/23 |
| 185 | 30/8 |
| 300 | 38/0 |

[1]sulfonic acid obtained with HF as catalyst;
[2]lialet 125 - 5 Condea.

Therefore preferred compositions have a low viscosity of less than 190 cps, ideally less than 100 cps, with a ratio of LAS to non-ionic of between 0.5:1 to 1:0.5 and, preferably, the total amount of surfactant is less than 50% wt of the composition.

The present invention is now further described in the following Examples in which all the parts are parts by weight unless otherwise mentioned.

EXAMPLE 1

A Fine-Fabric Laundry Composition

The following components were mixed together:

| | |
|---|---|
| Monopropylene glycol | 15.0 parts |
| Genapol AO 3070 | 12.0 parts |
| Solfodac AC3-I | 45.0 parts |
| Monoethanolamine | 5.0 parts |

The composition was then subjected to continuous cooling, and the following components were added:

| | |
|---|---|
| Triethanolamine | 10.0 parts |
| Coconut fatty acid | 2.0 parts |
| Marlinat 242/90M | 9.0 parts |
| Bitrex (trade mark) | 0.005 parts |
| Dye (1% aqueous solution) | 0.13 parts |
| Perfume | 1.44 parts |

Genapol AO 3070 is a $C_{14-15}$ fatty alcohol ethoxylated with 3 or 7 ethylene oxide units in a 1:1 ratio.

Marlinat 242/90M is a $C_{10}$–$C_{14}$ alcohol polyethylene glycol(2EO), ether sulfate, monoisopropanolammonium salt.

The composition was mixed until homogeneous. A Multivac thermoforming machine operating at 6 cycles/min. and at ambient conditions of 25° C. under 35% RH(±5% RH) was used to thermoform a PVOH film. This was Monosol M8534 obtained Chris Craft Inc., Gary, Ind., USA, having a degree of hydrolysis of 88% and a thickness of 100 $\mu$m. The PVOH film was thermoformed into a rectangular mould of 39 mm length, 29 mm width and 16 mm depth, with its bottom edges being rounded to a radius of 10 mm at 115 to 118° C. The thus formed pocket was filled with 17 ml of the above composition, and is 75 $\mu$m thick film of Monosol M8534 PVOH was placed on top and heat sealed at 144 to 148° C.

The detergent composition was found to dissolve satisfactorily in domestic laundry machines. It was also found to dissolve quickly when added to a large quantity of water having a hardness of 25° F. at 20° C. to provide a final solution containing the detergent composition in an amount of 5 wt %.

EXAMPLES 2 TO 9

Example 1 was repeated, except for replacing the Genapol AO 3070 by the following components.

| | |
|---|---|
| Example 2: | Genapol UD 079 obtainable from Clariant, being a $C_{11}$ fatty alcohol ethoxylated with 7 ethylene oxide units. |
| Example 3: | Genapol UD O3O obtainable from Clariant, being a $C_{11}$ fatty alcohol ethoxylated with 3 ethylene oxide units. |
| Example 4: | Genapol OA O5O obtainable from Clariant, being a $C_{14-15}$ fatty alcohol ethoxylated with 5 ethylene oxide units. |
| Example 5: | Lutensol TO3-TO7-1:1 obtainable from BASF, being a $C_{13}$ fatty alcohol ethoxylated with 3 or 7 ethylene oxide units in a 1:1 ratio. |

-continued

| | |
|---|---|
| Example 6: | Lutensol TO7 obtainable from BASF, being a $C_{13}$ fatty alcohol ethoxylated with 7 ethylene oxide units. |
| Example 7: | Lutensol TO5 obtainable from BASF, being a $C_{13}$ fatty alcohol ethoxylated with 5 ethylene oxide units. |
| Example 8: | Lutensol AO7 obtainable from BASF, being a $C_{13-15}$ fatty alcohol ethoxylated with 7 ethylene oxide units. |
| Example 9: | Dehydol LT7 obtainable from Henkel, being a $C_{12-18}$ fatty alcohol ethoxylated with 7 ethylene oxide units. |

In all instances the composition was found to dissolve satisfactorily in a large amount of water following the test set out in Example 1.

EXAMPLE 10

A Laundry Detergent Booster Composition

| | Parts |
|---|---|
| Lialet 125/5 (nonionic) | 23 |
| Petresul 550 (lauryl alkyl sulfonate) | 15.5 |
| Genencor Properase (protease) | 2.0 |
| Glycerol | 8.0 |
| Borax (Na tetraborate decahydrate) | 2.0 |
| Monopropylene glycol | 42.0 |
| Kathon GC | 0.1 |
| PEG 200 | 5.0 |
| Coconut oil | 2 |
| Monoethanolamine (MEA) | 3.5 |

The following components were mixed together:

| | |
|---|---|
| Monopropylene glycol | 42 parts |
| PEG 200 | 5 parts |
| Nonionic | 23 parts |
| Kathon | 0.1 parts |
| Coconut fatty acid | 2 parts |
| LAS Solfodoc AC3-D | 15.5 parts |
| MEA | 3.5 |

The temperature rise up to 60° C. and while the solution cooled to room temperature was prepared in a separated batch an enzymatic solution made with:

| | |
|---|---|
| Glycerol | 67 parts |
| Borax | 16.5 parts |
| Enzyme | 16.5 parts |

When the first solution was at room temperature were added 12 parts of the enzymatic solution under rapid stirring. At the end the dye is added 0.002 parts

EXAMPLE 11–18

In a similar way to the preparation of Example 10 the following examples were prepared

| Ingredient | Parts |
|---|---|
| Lialet 125/5 (non-ionic Condea) | 24.00 |
| LAS (sulfonic acid - HF alkylation process) | 15.5 |
| Properase 1600 | 2.00 |
| Dye | 0.0002 |
| Glycerol | 8.00 |
| Borax | 2.00 |
| Monoprop. Glyc. | 41.40 |
| Kathon GC (perservative Rohm and Haas) | 0.10 |
| PEG 200 | 5.00 |
| Soap Coco | 2.00 |
| Total | 100.00 |

| | |
|---|---|
| Lialet 125/5 (nonionic from Condea) | 24.00 |
| LAS (sulfonic acid - HF alkylation process) | 20 |
| Properase 1600 L | 2.00 |
| Dye | 0.0002 |
| Glycerol | 8.00 |
| Borax | 2.00 |
| Monoprop. Glyc. | 36.9 |
| Kathon GC (perservative form Rohm and Haas) | 0.10 |
| PEG 200 | 5.00 |
| Soap Coco | 2.00 |
| Total | 100.00 |

| | |
|---|---|
| Lialet 125/5 (nionionic surfactants) | 24.00 |
| LAS (sulfonic acid - HF alkylation process) | 20 |
| Properase 1600 L | 2.00 |
| Dye | 0.0002 |
| Glycerol | 8.00 |
| Borax | 2.00 |
| Monoprop. Glyc. | 36.8 |
| Kathon GC (perservative form Rohm and Haas) | 0.10 |
| Lytron (opacisier) | 0.10 |
| PEG 200 | 5.00 |
| Soap Coco | 2.00 |
| Total | 100.00 |

| | |
|---|---|
| Lialet 125/5 (nionionic surfactants) | 24.00 |
| LAS (sulfonic acid - HF alkylation process) | 15.5 |
| Properase 1600 L | 2.00 |
| Dye | 0.0002 |
| Glycerol | 8.00 |
| Borax | 2.00 |
| Monoprop. Glyc. | 41.3 |
| Kathon GC (perservative form Rohm and Haas) | 0.10 |
| Lytron (opacisier) | 0.10 |
| PEG 200 | 5.00 |
| Soap Coco | 2.00 |
| | 100.00 |

| | |
|---|---|
| Lialet 125/5 (nionionic surfactants) | 24.00 |
| LAS (sulfonic acid - HF alkylation process) | 20 |
| Properase 1600 L | 2.00 |
| Dye | 0.0002 |
| Glycerol | 8.00 |
| Borax | 2.00 |
| Monoprop. Glyc. | 34.9 |
| Kathon GC (perservative form Rohm and Haas) | 0.10 |
| Aerosil 200 (silica form Degussa) | 2.0 |
| PEG 200 | 5.00 |
| Soap Coco | 2.00 |
| Total | 100.00 |

| | |
|---|---|
| Lialet 125/5 (nionionic surfactants) | 24.00 |
| LAS (sulfonic acid - HF alkylation process) | 20 |
| Properase 1600 L | 2.00 |
| Dye | 0.0002 |
| Glycerol | 8.00 |
| Borax | 2.00 |
| Monoprop. Glyc. | 36.8 |
| Kathon GC (perservative form Rohm and Haas) | 0.10 |
| Aerosil 200 (silica form Degussa) | 2.0 |
| Lytron (opacisier) | 0.1 |
| PEG 200 | 5.00 |
| Soap Coco | 2.00 |
| Total | 100.00 |

-continued

| Ingredient | Parts |
|---|---|
| Lialet 125/5 (nionionic surfactants) | 24.00 |
| LAS (sulfonic acid - HF alkylation process) | 15.5 |
| Properase 1600 L | 2.00 |
| Dye | 0.0002 |
| Glycerol | 8.00 |
| Borax | 2.00 |
| Monoprop. Glyc. | 41.3 |
| Kathon GC (perservative form Rohm and Haas) | 0.10 |
| Aerosil 200 (silica form Degussa) | 2.0 |
| Lytron (opacisier) | 0.1 |
| PEG 200 | 5.00 |
| Soap Coco | 2.00 |
| Total | 100.00 |
| Lialet 125/5 (nionionic surfactants) | 24.00 |
| LAS (sulfonic acid - HF alkylation process) | 15.5 |
| Properase 1600 L | 2.00 |
| Dye | 0.0002 |
| Glycerol | 8.00 |
| Borax | 2.00 |
| Monoprop. Glyc. | 41.4 |
| Kathon GC (perservative form Rohm and Haas) | 0.10 |
| Aerosil 200 (silica form Degussa) | 2.0 |
| PEG 200 | 5.00 |
| Soap Coco | 2.00 |
| Total | 100.00 |

COMPARATIVE EXAMPLE A

The following components were mixed together:

| | |
|---|---|
| Monopropylene glycol | 8.0 parts |
| Lutensol AO7 | 20.0 parts |
| Alkyl benzene sulfonic acid obtained using an $AlCl_3$ catalyst | 45.0 parts |
| Triethanolamine | 27.0 parts |

The composition did not dissolve satisfactorily in a large amount of water following the test set out in Example 1.

COMPARATIVE EXAMPLE B

The following components were mixed together:

| | |
|---|---|
| Lutensol AO7 | 20.0 parts |
| Alkyl benzene sulfonic acid obtained using an $AlCl_3$ catalyst | 50.0 parts |
| Triethanolamine | 30.0 parts |

The composition did not dissolve satisfactorily in a large amount of water following the test set out in Example 1.

COMPARATIVE EXAMPLE C

The following components were mixed together:

| | |
|---|---|
| Monopropylene glycol | 6.5 parts |
| Lutensol AO7 | 11.0 parts |

-continued

| | |
|---|---|
| Alkyl benzene sulfonic acid obtained using an $AlCl_3$ catalyst | 45.0 parts |
| Triethanolamine | 30.0 parts |
| Coconut fatty acids | 7.5 parts |

The composition did not dissolve satisfactorily in a large amount of water following the test set out in Example 1.

What is claimed is:

1. A water-soluble container containing a composition comprising a) an alkyl benzene sulfonic acid neutralised with an alkanolamine, said alkyl benzene sulfonic acid containing less than 25% of the 2-phenyl isomer; and b) an organic solvent; said composition containing less than 3 wt % water.

2. A container according to claim 1 which comprises a thermoformed or injection moulded water-soluble polymer.

3. A container according to claim 1 wherein the water-soluble polymer is a poly (vinyl alcohol).

4. The container according to claim 1 wherein the alkyl benzene sulfonic acid contains less than 20% of the 2-phenyl isomer.

5. A container according to claim 1 wherein the alkyl benzene sulfonic acid contains less than 15% of the 2-phenyl isomer.

6. A container according to claim 1 wherein the alkyl benzene sulfonic acid is a $C_{9-14}$ alkyl benzene sulfonic acid.

7. A container according to claim 6 wherein the alkyl benzene sulfonic acid is a $C_{10-13}$ alkyl benzene sulfonic acid.

8. A container according claim 1 wherein the alkyl benzene sulfonic acid has been produced by the HF-catalysed process.

9. A container according to claim 1 wherein the alkanolamine is monoethanolamine, diethanolamine, triethanolamine or a mixture thereof.

10. A container according to claim 9 in which the alkanolamine is a mixture of monoethanolamine and triethanolamine.

11. A container according to claim 1 wherein the organic solvent is a glycol, glycerine or an alcohol or a mixture thereof.

12. A container according to claim 11 wherein the organic solvent is monopropylene glycol or ethanol.

13. A container according to claim 1 wherein the composition contains less than 1 wt % water.

14. A container according to claim 13 wherein the composition is anhydrous.

15. A container according to claim 1 wherein the composition comprises from 10 to 60 wt % alkyl benzene sulfonic acid neutralised with an alkanolamine.

16. A container according to claim 1 wherein the composition comprises from 10 to 20 wt % organic solvent.

17. A container according to claim 1 wherein the composition comprises a nonionic surfactant.

18. A container according to claim 1 wherein the composition has a pH of from 5.5 to 7.

19. A container according to claim 1 wherein the composition is a laundry composition.

20. A container according to claim 19 wherein the laundry composition is a fine fabric laundry composition.

* * * * *